US008556508B2

(12) United States Patent
Persenda

(10) Patent No.: US 8,556,508 B2
(45) Date of Patent: Oct. 15, 2013

(54) BAG HAVING AN ELASTIC BAND, AND METHOD FOR THE PRODUCTION THEREOF

(75) Inventor: John Persenda, Paris (FR)

(73) Assignee: Sphere, Paris (FR)

( * ) Notice: Subject to any disclaimer, the term of this patent is extended or adjusted under 35 U.S.C. 154(b) by 2113 days.

(21) Appl. No.: 10/572,938

(22) PCT Filed: Sep. 13, 2004

(86) PCT No.: PCT/FR2004/002316

§ 371 (c)(1),
(2), (4) Date: May 10, 2006

(87) PCT Pub. No.: WO2005/030612

PCT Pub. Date: Apr. 7, 2005

(65) Prior Publication Data

US 2007/0036472 A1 Feb. 15, 2007

(30) Foreign Application Priority Data

Sep. 24, 2003 (FR) ..... 03 11208

(51) Int. Cl.
*B65D 33/00* (2006.01)

(52) U.S. Cl.
USPC ..... 383/33; 383/75; 383/73; 383/77

(58) Field of Classification Search
USPC ..... 383/33, 75, 12, 71–74, 76, 77
See application file for complete search history.

(56) References Cited

U.S. PATENT DOCUMENTS

| | | | | |
|---|---|---|---|---|
| 5,120,138 | A * | 6/1992 | Midgley et al. | 383/7 |
| 5,232,118 | A * | 8/1993 | Samuel | 220/495.11 |
| 5,997,178 | A * | 12/1999 | Nye et al. | 383/33 |
| 6,164,824 | A * | 12/2000 | McGlew et al. | 383/75 |
| 6,585,415 | B2 * | 7/2003 | Malaspina | 383/75 |
| 6,921,202 | B2 * | 7/2005 | Raterman | 383/33 |
| 6,939,042 | B2 * | 9/2005 | Rusnak et al. | 383/71 |

FOREIGN PATENT DOCUMENTS

| | | | |
|---|---|---|---|
| CH | 687 142 | | 9/1996 |
| EP | 1 013 567 | | 6/2000 |
| EP | 1232954 | A1 * | 8/2002 |
| FR | 2797254 | A1 * | 2/2001 |

* cited by examiner

*Primary Examiner* — Jes F Pascua
*Assistant Examiner* — Peter Helvey
(74) *Attorney, Agent, or Firm* — Young & Thompson

(57) ABSTRACT

The bag (1) includes an elastic band (16) joined to the face (1*a*) of the bag by two joining areas (17; 2*a*) in such a manner that the useful length, when the elastic band is at rest (L2), corresponds to the space between the two joining areas on the bag or is less than the length (L1) of the longitudinal edge of the face. The elastic band extends over the entire width of the bag, from one lateral edge to the other, the elastic band being welded to two faces of the bag along these lateral edges, one of the at least two joining areas forming an intermediate joining area (17) located at a distance from the lateral edges.

20 Claims, 3 Drawing Sheets

BAG HAVING AN ELASTIC BAND, AND METHOD FOR THE PRODUCTION THEREOF

The present invention relates to a bag, in particular made of plastic, especially a bag for storing household waste, having an elastic band surrounding the opening of the bag to hold the bag elastically on a garbage can, and to a method for the production of such a bag.

BACKGROUND OF THE INVENTION

In general, in industrialized countries, garbage and waste, especially household waste, are kept in plastic bags. These plastic bags generally comprise two faces made of plastic joined to one another around their periphery forming an open region. These bags are usually rectangular, although other shapes are possible: for example, the bottom of the bag may be rounded. In the rest of the description, for convenience, reference will be made to rectangular bags, although it is of course understood that the bags according to the present invention are not limited to this shape.

The bags may be prepared from two rectangular plastic sheets, by welding three sides of the rectangle and leaving the fourth side open. They may also be prepared from a single plastic sheet which is folded, either to form the bottom of the bag or to form a lateral side of the bag, two of the other sides being heat welded. In a known manner, the faces of the bag may be joined to one another via a gusset at the bottom and/or along one lateral side, preferably along both lateral sides.

It is also known to produce drawstring bags in which the opening of the bag, however it is made, is bordered by a hem in which a drawstring can slide. The drawstring may consist of a single tape, the two ends of the drawstring being joined together. It may also consist of two tapes, each tape being fixed by each of its ends to the hem. The drawstring is preferably a strip of plastic which can be heat welded.

The hem is generally prepared by folding the plastic sheet parallel to the opening and heat welding it parallel to the edge of the film. The hem may be continuous or formed of two-separate parts. This is in particular the case when the bags are made by heat welding the lateral sides and the hem is formed by folding the plastic sheet before heat welding the lateral sides.

Such bags with plastic, substantially non-elastic drawstrings are described in the applicant's patents EP-953 511 and EP-1 232 954.

A drawstring bag in which the drawstring is elastic or expandable has also been proposed in the prior art, for example in patent U.S. Pat. No. 5,133,607, in German utility model DE-201 10 350-U1 and in international application WO 03/035500. This closed-loop elastic drawstring is characterized in that the length of its periphery is shorter than that of the opening of the bag, in such a way that the user must elastically stretch the drawstring to fix it around the periphery of a receptacle, for example a garbage can. Thus, this drawstring makes it possible to hold the bag elastically on the garbage can, for a wide range of sizes of garbage can, while limiting the risk of the bag slipping inside the garbage can, for example under the weight of the waste inside the bag.

However, the abovementioned elastic drawstring bags have a twofold disadvantage, owing to the presence of relatively deep lateral notches made on the longitudinal edge of opening of the bag. The presence of these relatively wide notches first of all has the disadvantage of not allowing the bag to close completely when the drawstring is tied once the bag has been filled. Thus, when bags full of waste are transported or stored, waste can fall or leak out of these notches. Secondly, the presence of these relatively wide notches reduces the length of the hem in contact with the drawstring, weakening the bag when it is transported full using the elastic drawstring as a handle.

Moreover, all these elastic drawstring bags have the shared disadvantage that the elastic drawstring may not have sufficient tensile strength to support a heavy weight of waste in the bag during transport. Furthermore, even if the tear strength is sufficient, if the weight of waste in the bag is great, there is the risk that the drawstring, which is generally used as a handle by the user when transporting the bag, will stretch elastically, which may cause the bag to drag along the ground or cause it to lower enough that it knocks against obstacles, which is a considerable hindrance for the user.

Also known, from document EP-A-1 013 567, is a plastic drawstring bag comprising an elastic strip whose ends are fixed with a hot melt adhesive to one of the outer faces of the bag, near to but at a distance from the hem enclosing the plastic drawstring. This elastic strip can be grasped from the outside by the user, after the edge of the bag has been folded over the neck of a garbage can, and the user can stretch it elastically so that the strip forms a closed loop which can surround the periphery of the container, holding the bag elastically on the garbage can. Although the elastic strip, preferably made of rubber, can be chosen so as to have a maximum elongation of 800%, this elastic strip preferably has an elastic elongation of below 500%. In a first example, the elastic strip has a relaxed length of around a quarter of the length of the periphery of the container. In a first variant, the elastic strip is stretched so as to extend around only three sides of the container, corresponding to an elastic elongation of around 200%, i.e. a tripling of its length. In another variant, the elastic strip is stretched so as to form a closed loop which completely surrounds the periphery of the container, corresponding to an elastic elongation of around 400%, i.e. five times its relaxed length. In another example, the elastic strip has a length slightly shorter than half the periphery of the container, in such a way that it is necessary to form a closed loop with the elastic strip to hold the bag elastically on the container, corresponding to an elastic elongation of at least 200%, i.e. at least a tripling of its length. Advantageously, this elastic strip is only used to hold the bag elastically on the container, whereas the plastic drawstring is used for tying, so as to close the bag.

Similarly, document EP-A-1 266 837 describes a plastic drawstring bag also comprising an elastic strip which is fixed at its ends to the lateral edges of the bag and is, in a variant, housed in the same hem as the plastic drawstring, or placed on the outer face of said hem. As in document EP-A-1 013 567, to hold the bag elastically on a garbage can, it is necessary to form a closed loop with the elastic strip and to this end it is provided that the elastic elongation of the strip must be greater than 200%, for example 250%, preferably 300% or more.

However, these two documents EP-A-1 013 567 and EP-A-1 266 837, which concern the same type of plastic drawstring bag having an elastic strip for holding the bag on a container, use elastic strips having a high degree of elastic elongation, above 200%, which thus requires the use of special elastic materials, which may be difficult to weld or join to the bag and which are, moreover, difficult to implement in a method for the continuous production of a series of bags, since there is a risk that the high degree of elasticity of the strip will interfere with the many welding, folding and cutting operations necessary to produce, for example, a continuous roll of a series of bags. Specifically, in such a continuous production method, the plastic sheets constituting the faces of the bag and the various drawstrings and strips are held on multiple drive wheels or rolls to ensure minimum tensioning of all these elements. However, a highly elastic strip thus tensioned may deform elastically during the process of production of the series of bags, adversely affecting the quality of the heat welds, or even causing the bag to pucker if these heat welds are not applied correctly.

It is for this reason, moreover, that in document EP-A-1 013 567 the elastic strips are bonded individually and separately to each bag of the series of bags, either transversely to the direction of advance of the series of bags, or parallel to said direction.

The aim of the invention is therefore to propose a bag having an elastic band for fixing the periphery of the bag elastically to a receptacle and which makes it possible to avoid the abovementioned disadvantages. Another aim of the invention is to prevent the risk of waste falling out of the bag after it has been closed. The invention also aims to limit the risk of the elastic band breaking or tearing or the risk of the elastic band deforming during transport of the bag, especially when full of waste.

SUMMARY OF THE INVENTION

To this end the subject of the invention is a bag consisting of two faces joined together around their whole periphery, with the exception of one longitudinal edge, the bag having an opening emerging at said longitudinal edge, the two faces of the bag being welded to one another along two opposite lateral edges, at least one face having, near said opening, at least one elastic band joined to said face by two connection regions in such a way that the effective relaxed length of said elastic band between the two connection regions corresponds to the gap between the two connection regions on the bag and is shorter than the length of the longitudinal edge of said face of the bag, a bag of this type being described in document EP-A-1 013 567. The bag according to the invention is characterized in that the elastic band extends across the whole width of the bag, from one lateral edge to the other, said elastic band being welded to the two faces of the bag along said lateral edges, at least one of the abovementioned two connection regions forming an "intermediate" connection region located at a distance from the abovementioned two lateral edges. Within the meaning of the invention, the effective relaxed length of the elastic band may vary slightly, depending on the elasticity of the band and its slight deformation when it is welded to the bag. This elastic band, which is not housed in a hem, may thus be produced continuously in a method for the production of a series of bags, while having a short effective length, corresponding to the contraction of the expandable part of said elastic band which can be grasped from the outside, owing to the presence of the intermediate connection region between the two lateral edges of the bag.

By contrast, in document EP-A-1 013 567, the elastic band has a relaxed length which is markedly shorter than the width of the bag. Even if there is a passage, in purely general terms without any example of embodiment, which states that this band may extend across the whole width of the bag, nowhere is it provided that it may be welded to the lateral edges of the bag. This band is in practice fixed by a hot melt adhesive, which cannot therefore be located at the welds of the lateral edges of the bag without adversely affecting the adhesion of the band to the bag. Each band is bonded, individually and discontinuously, as shown in FIGS. 7 and 17, directing the person skilled in the art away from the present invention, which concerns the welding of an elastic band which is continuous along the length of a series of bags.

Advantageously, each face of the bag comprises a hem bordering said opening, in which is placed a non-elastic drawstring, it being possible for each non-elastic drawstring to be grasped from the outside via at least one notch made through said hems, in such a way that the purpose of this non-elastic drawstring is essentially to be tied in order to close the bag whereas the elastic band is essentially used to hold the bag elastically on a container.

In this case it may be provided that each face of the bag is folded inward, along the longitudinal edge of the bag, in such a way that part of the fold forms the abovementioned hem and extends beyond it by a skirt, said elastic band being joined to the corresponding face of the bag by overlapping said skirt at least partially. Thus, the intermediate connection region may be made at least partially on a double thickness of plastic sheets consisting of one face of the bag and said skirt. Preferably, this intermediate connection region does not extend into the part of the fold forming the hem, so as to leave the non-elastic drawstring free to slide in the hem. The fact that the elastic band is welded at its intermediate connection zone on a double thickness of sheets makes it possible to reinforce this intermediate weld which is subjected to high tensile stresses.

As a variant, each face of the bag associated with the elastic band is folded inward along the longitudinal edge of the bag, in such a way that the elastic band is joined to said face, overlapping said fold at least partially. Thus, even when the bag does not comprise a drawstring in a hem, it is advantageous to provide an inside fold to ensure a double thickness of plastic sheets at the intermediate connection region between the elastic band and the bag.

According to another feature, the other of the abovementioned two connection regions forms another intermediate connection region located at a distance from the abovementioned two lateral edges and from the first intermediate connection region.

As a variant, the other of the abovementioned two connection regions consists of the region where the elastic band is welded to the lateral edge of the bag furthest from the abovementioned intermediate connection region. In this case, the two faces of the bag form a double thickness of sheets for the connection of the elastic band at the lateral edge.

Preferably, each elastic band is joined to an inside face of the bag. However, as a variant, each elastic band may be joined to an outer face of the bag.

In another particular embodiment, each elastic band is cut longitudinally into two vertically adjacent tapes, whose respective connection regions lie in the vertical extension of one another, so that the two tapes form a closed loop with the bag, each tape of said loop being designed to extend around an opposite side of a container. In this case, one of the tapes will stay along the face of the bag which bears it while the other will be elastically stretched so as to extend around the opposite side of the container. The intermediate connection region of the stretched elastic tape, which is subjected to the greatest stresses, is thus locally reinforced via the intermediate connection region of the adjacent tape.

According to yet another feature of the invention, the elastic band has a degree of elongation of less than 150%, and preferably of around 100%. For example, this elastic band is based on ethylene vinyl acetate (EVA).

The present invention also relates to a method for the continuous production of a series of bags, said method comprising the steps consisting in:

a) placing at least one elastic strip inside a folded sheet, along one of the longitudinal edges of the sheet;

b) making, at regular intervals corresponding to the width of a bag, at least one transverse heat weld limited to the height of the elastic strip only, so as to form an intermediate connection region between the elastic strip and the corresponding inside face of the sheet;

c) making, at regular intervals corresponding to the width of a bag, a plurality of pairs of adjacent transverse heat welds corresponding to the lateral edges of the bags, in such a way as to heat weld the abovementioned elastic strip to the lateral edges of the bags, said pairs of transverse heat welds being made at a distance from the abovementioned limited transverse heat welds;

d) making pre-cuts, at regular intervals, on the sheet between the transverse heat welds of each pair, to form a series of pre-cut bags.

This production method has the advantage of allowing continuous production of a series of bags having an elastic band whose effective relaxed length is shorter than the width of one face of the bag, without the risk of the body of the bag puckering.

Advantageously, the method comprises the additional step of:

e) before step a) or b), folding each longitudinal edge of the sheet inward to form an internal fold, the abovementioned elastic strip being placed on a fold, with an at least partial overlap, so that the elastic strip is welded in step b) to at least one double thickness of material in its intermediate connection region.

According to yet another feature of the invention, the method comprises the additional steps, before step a), of:

f) cutting portions of film near the two longitudinal edges of the folded sheet, at regular intervals corresponding at least to the width of a bag, for example one or two bag widths;

g) placing two non-elastic strips inside said folded sheet, in line with said cut portions on each face of the sheet so that each non-elastic strip is housed inside a fold;

h) heat welding the folds parallel to the longitudinal direction, to form a hem in which each non-elastic strip is housed, the elastic strip at least partially overlapping the remaining portion of the fold which forms a skirt.

BRIEF DESCRIPTION OF THE DRAWINGS

The invention will be more clearly understood, and further aims, details, features and advantages thereof will emerge more clearly in the course of the following description of several particular embodiments of the invention, provided only by way of non-limiting illustration, with reference to the attached drawings, in which.

DETAILED DESCRIPTION OF THE PREFERRED EMBODIMENTS

Figure 1:
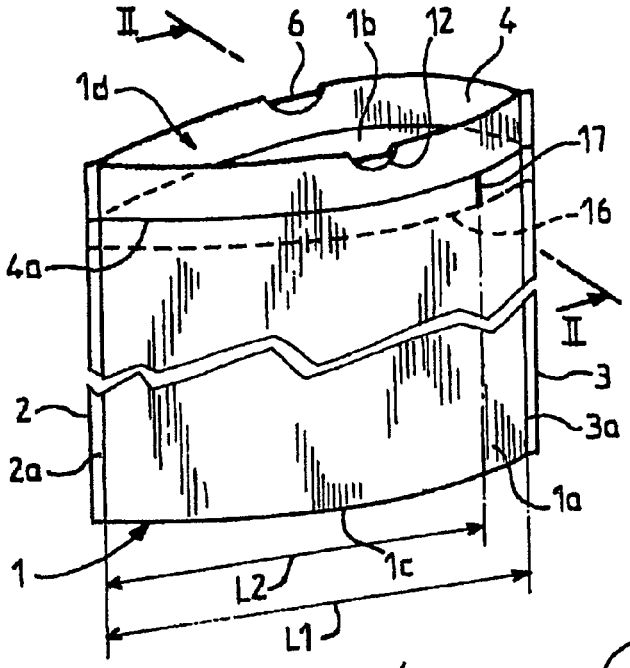
FIG. 1 is a view in elevation and perspective of a first embodiment of a bag according to the invention, with an elastic band and a non-elastic drawstring.
Figure 2:
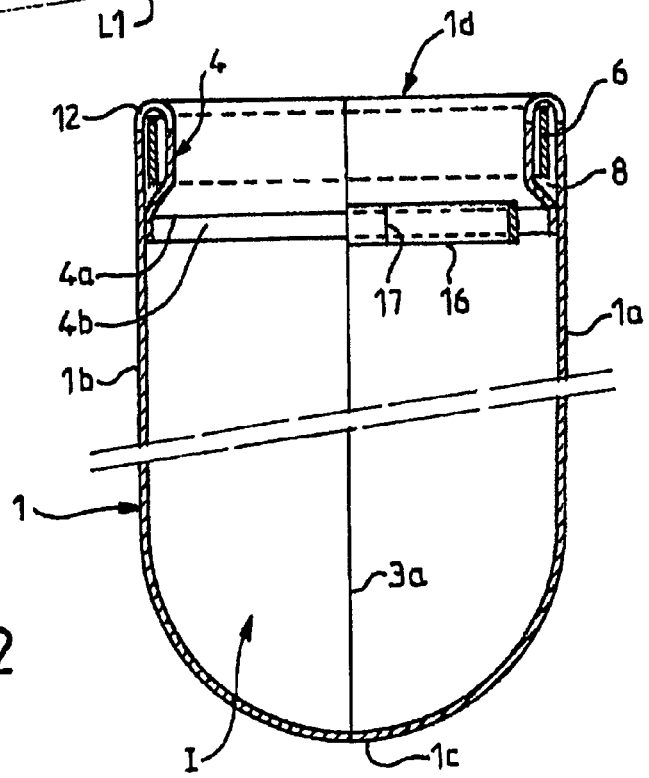
FIG. 2 is a view in section along the line II-II of FIG. 1, with the bag in the open position.

In the first embodiment shown in FIGS. 1 and 2 it can be seen that the bag 1 according to the invention consists of two substantially parallel rectangular faces 1*a*, 1*b*, the faces 1*a*, 1*b* consisting of the same plastic sheet folded to form the bottom 1*c* of the bag, this bottom 1*c* being rounded when the bag is in the carried position, as shown in FIG. 2. In the storage position, the faces 1*a* and 1*b* are brought against one another and joined at the bottom 1*c* via a flat fold, as shown in FIG. 1. On their lateral edges 2 and 3, the faces 1*a* and 1*b* are joined together by corresponding welds 2*a* and 3*a*. These welds 2*a* and 3*a* run substantially over the whole height of the bag 1 and form a vertical line, but these welds could be non-linear, extending over the whole of the lateral marginal area of the bag.

On the side opposite the bottom 1*c*, the periphery of the bag comprises an open region 1*d* defined along the longitudinal edge of each face 1*a* and 1*b*, the longitudinal edge of each face 1*a* and 1*b* being extended, at the open region 1*d*, by an internal fold 4, one end of which is welded to the corresponding face of the bag by a longitudinal weld 4*a*. This fold 4 extends beyond the longitudinal weld 4*a* by a skirt 4*b*, which may be free or itself welded to the corresponding face of the bag.

The longitudinal weld 4*a* is preferably continuous over the whole width of the bag. It may also be non-continuous, in a broken or dotted line.

In the embodiment shown in FIGS. 1 and 2, it can be seen that the internal fold 4 forms a hem 8 in which a non-elastic drawstring 6 is placed. An elastic band 16, which is joined to the lateral edges 2 and 3 by the transverse weld lines 2*a* and 3*a*, is placed on the skirt 4*b* of the face 1*a* of the bag. As is more clearly visible in FIG. 2, the elastic band 16 overlaps the skirt 4*b* completely, without however interfering with the hem 8, so that the non-elastic drawstring, which is for example made of plastic, can slide freely between its ends which are also welded via the transverse welds 2*a* and 3*a*. The lower edge of the elastic band 16 can project beyond or lie exactly flush with the lower edge of the skirt 4*b*. The elastic band 16 has an "intermediate" connection region 17 where it is joined to the face 1*a* of the bag, which consists of a vertical weld line or line of adhesive or the like, this line 17 being limited to the height of the band 16. Advantageously, the elastic band 16 overlaps the longitudinal weld 4*a*, without however interfering with the drawstring 6, so that the tensile stresses exerted on the line 17 are taken up by the weld 4*a*, thus improving the tear strength of the line 17. Naturally, as a variant, each face of the bag may comprise an elastic band.

FIGS. 1 and 2 show a notch 12 substantially in the mid part of each hem 8, along the longitudinal edge of the opening of the bag, the notch 12 passing through the faces 1*a* and 1*b* of the bag, on either side of it. This notch is shown here with a substantially semi-circular shape, but it could have any shape, for example oval or square, or any other, and it is not necessary for the drawstring 6 to be visible over all of its height through the notch 12. This notch 12 can be provided laterally, in a manner substantially similar to the notch 112 which will be described below with reference to the embodiments of FIGS. 6 and 7.

Figure 8:
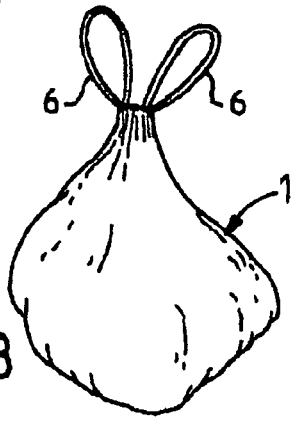
FIG. 8 is a schematic view showing the bag of FIG. 1 in a closed position, the plastic drawstring ready to be tied.

The main function of the elastic band 16 is to make it possible to elastically adjust the periphery of the bag on the edge of a receptacle, whereas the non-elastic drawstring 6 will be used mainly for carrying the bag once filled with waste and/or for tying the drawstrings 6 to close the bag (see FIG. 8). Given the arrangement of the drawstring 6 and the band 16, it will be understood that when closed the bag will be completely closed, preventing or reducing the risk of waste falling out of the bag during transport or storage. When the bag is being transported full, it is the other drawstring 6 made of plastic which is used, to prevent the elastic band from deforming.

In FIG. 2, the reference I indicates the inside of the bag in the open position.

The elastic band 16 is placed across the whole width of the bag, from one lateral edge 2 to the other 3, in a tensioned but not elastically stretched state when the bag is flat, to prevent any puckering of the bag. The limited weld line 17 is made near a lateral edge 3 of the bag, in such a way that the elastically deformable portion of the band 16 which can be grasped from the outside is that between the line 17 and the furthest away opposite lateral edge 2. Thus, the gap L2 between the two welds 2*a* and 17 on the elastic band 16 is substantially smaller than the length L1 between the welds of the two lateral edges 2 and 3 of the bag, resulting in an elastic band having an effective relaxed length which is shorter than that of the opening of the bag. By way of non-limiting example, for a bag with a capacity of 30 liters and a length L1 of around 50 cm (half perimeter) it is possible to position the connection region 17 in such a way as to obtain a gap L2 of around 34 cm. Thus, to hold the bag on a garbage can having a perimeter of around 1 meter, it is necessary to stretch the elastic band from 34 cm to 66 cm, returning the band to the side of the garbage can opposite that where said band is initially located, corresponding to a degree of elastic elongation of around 94%. In practice, it is desirable for the material to be chosen to have a degree of elastic elongation which is slightly greater to allow the band to be placed on the opposite side of the container. In general, the degree of elastic elongation necessary is still less than 150% and preferably around 100%. Thus, the length L2 may advantageously be chosen to be around ⅔ of L1.

Advantageously, the drawstring 6 and the band 16 are a different color than the sheet of which the faces 1*a* and 1*b* are made, and the drawstring and the band may themselves be distinguished by different colors.

By way of example, the elastic band 16, made for example of ethylene vinyl acetate (EVA), is selected so as to allow a degree of elastic elongation of less than 150%. The other non-elastic drawstring 6 is, for example, made of plastic, for example high-density polyethylene.

FIG. 2 shows the elastic band 16 in a slightly relaxed state inside the bag in the open position I, i.e. in a position in which the elastic band 16 is no longer necessarily in contact, in particular in its mid part, with the facing inside wall of the bag. Thus, the user can easily take hold of the elastic band 16 from the outside, by inserting his hand through the opening 1*d*.

Figure 3:
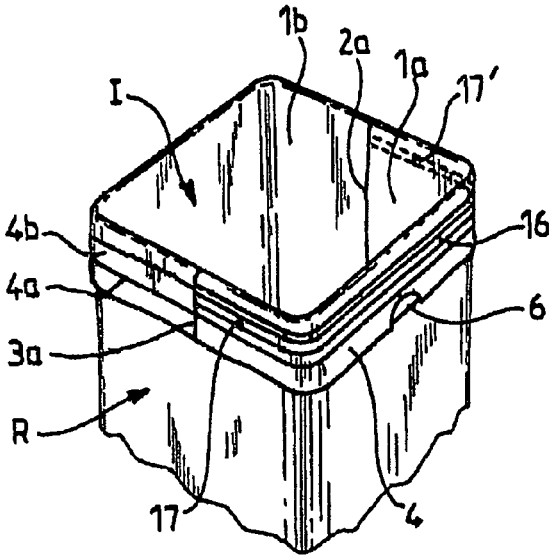
FIG. 3 is a partially cut away view in perspective of a second embodiment of the bag according to the invention mounted on the neck of a container, before the elastic band is tensioned.

In the embodiments shown in FIG. 3 and thereafter, the same reference numerals denote identical or similar elements.

Figure 4:
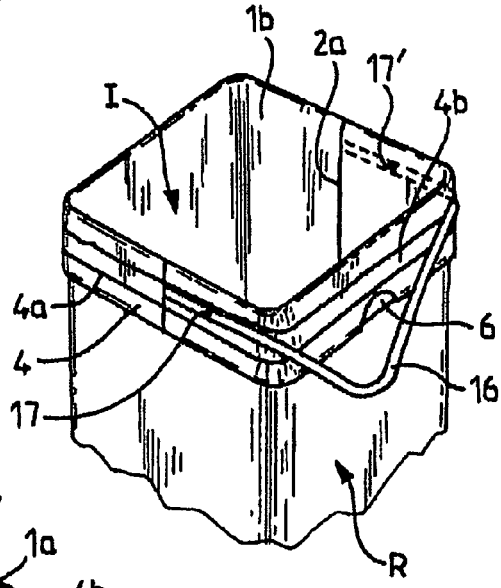
FIG. 4 is a view similar to FIG. 3, but showing the elastic band being stretched.
Figure 5:
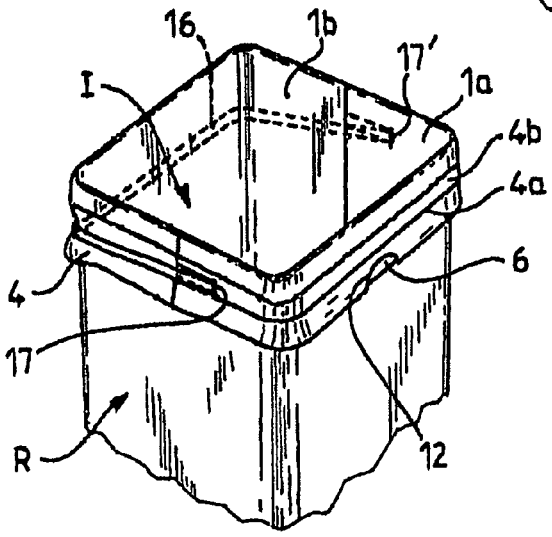
FIG. 5 is a view similar to FIG. 4, but showing the elastic band in the final position held elastically on the opposite edge of the container.

In the second embodiment shown in FIGS. 3 to 5, the bag differs from that shown in FIGS. 1 and 2 essentially in that the elastic band 16 is joined to the skirt 4*b* by two intermediate connection regions 17 and 17', which are mutually symmetric about a plane passing through the middle notches 12. Naturally, the two intermediate connection regions 17 and 17' could be placed at different distances from the respective lateral edges 3*a* and 2*a*, while remaining within the scope of the invention. The gap L2 is therefore in this case defined between the regions 17 and 17'. By way of example, for a 30 liter bag having a length L1 of 500 mm it is possible to arrange the regions 17 and 17' in such a way as to obtain a gap L2 of 34 cm, each region 17, 17' being spaced from its corresponding lateral edge 3 and 2 by around 8 cm, respectively. In this second embodiment, the elastic band 16 is located in its entirety on the skirt 4*b*, whereas in the first embodiment the elastic band projected on either side of the skirt.

When the bag is positioned on a container R, of rectangular, square, circular or other cross section, the rim of the bag at its opening is folded down over the peripheral edge of the container, as can be seen in FIG. 3, which advantageously reveals the elastic band 16 which now faces outward from the external wall of the container. When the elastic band is placed on the external wall of the bag, as described below with reference to FIGS. 6 and 7, the elastic band is then concealed between the external wall of the container and the folded-down rim of the bag, but the user can easily take hold of the elastic band by sliding his hand in between the folded-down rim of the bag and the external wall of the container and pull it downward and bring it over to the other side of the container.

In FIG. 4, the elastic band is shown as it is being stretched by the user, before he brings it over to the other side of the container, as shown in FIG. 5.

In FIG. 3, the elastic band is at rest, whereas in FIG. 5 the elastic band is elastically stretched, thus creating an elastic force sufficient to hold the bag on the container R. It is not necessary for this elastic band to be stretched until it forms a closed loop for encircling the entire periphery of the container.

Figure 6:
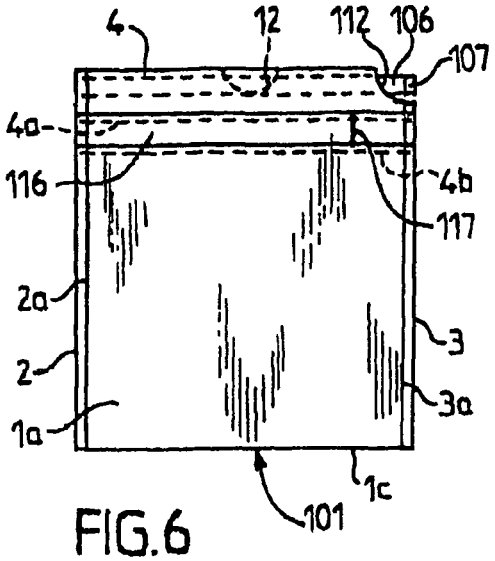
FIG. 6 is a view in elevation of a third embodiment of the bag according to the invention, comprising an external elastic band.

In the third embodiment shown in FIG. 6, the bag 101 differs from the abovementioned bag 1 essentially in that the middle notch 12 is optional, at least one lateral notch 112 being provided to provide access from the outside to the non-elastic drawstring 106. This non-elastic drawstring 106 is welded at one end to the lateral edge 2 of the bag, along the weld line 2*a*, whereas the opposite ends of the non-elastic drawstring 106 are welded together along a weld 107 which is made through the notch 112, in such a way that this end of the non-elastic drawstring 106 is not joined to the lateral edge 3 of the bag. This variant of the non-elastic drawstring is known per se.

Naturally, the bag 101 could have two lateral notches for grasping the plastic drawstring 106, while remaining within the scope of the present invention. Each lateral notch 112 may have any kind of shape, in particular a quarter of a circle, quarter of an ellipse or rectangle.

The bag 101 also differs in that the elastic band 116 is fixed to the external wall of the face 1*a* of the bag, its upper edge being located slightly above the abovementioned line 4*a*, while its lower edge is located above the lower edge of the skirt 4*b*. Thus, the elastic band 116 partially overlaps the skirt 4*b* and the portion of the fold 4 forming the hem for the drawstring 106, without it being possible for the drawstring 106 and the band 116 to be superposed.

The bag 101 is used in substantially the same way as the bag 1, as described with reference to FIGS. 3 to 5.

Figure 7:
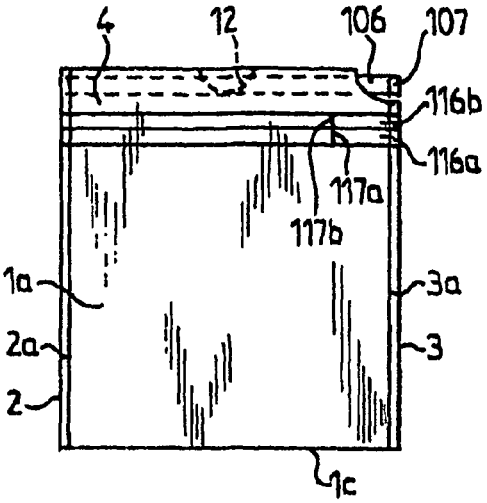
FIG. 7 is a view similar to FIG. 6, but showing a fourth embodiment of the bag according to the invention, in which the elastic band is cut into two tapes.

In the fourth embodiment shown in FIG. 7, the elastic band is cut or slit longitudinally into two separate tapes 116*a* and 116*b*, vertically adjacent and placed, for example, on the external wall of the face 1*a* of the bag. When the bag is placed on a container, the tape 116*a* can rest, for example, on the face 1*a* of the bag, without stretching, while the other tape 116*b* is stretched so as to extend around the other side of the container, like the abovementioned band 16. In this position, it could be considered that the two tapes 116*a* and 116*b* make, with the bag 101, a substantially closed loop around the container. Moreover, the intermediate connection region 117*b* which is subjected to high stress is locally reinforced by the presence of the intermediate weld 117*a* of the other tape 116*a*.

FIGS. 6 and 7 show in broken line the extra middle notch 12 which thus provides access to the non-elastic drawstring 106. However, such a middle notch 12 is not necessary, as the user can already access the non-elastic drawstring 106 via the lateral notch 112.

Figure 9:
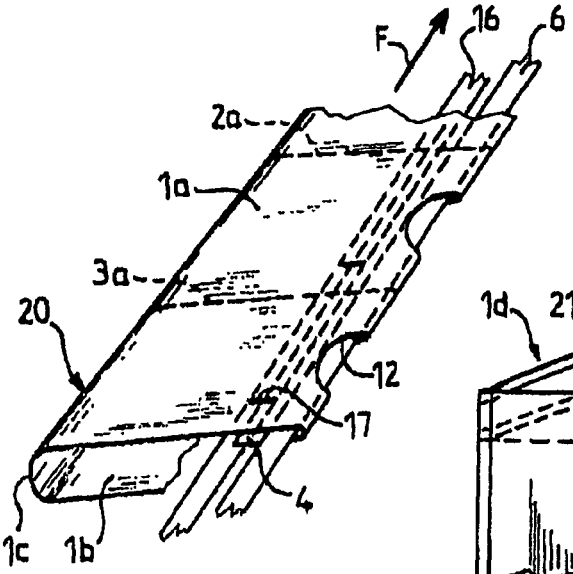
FIG. 9 is a partially cut away view in perspective of a step in the method for the production of a series of bags according to the first embodiment of the invention.

Reference will now be made more particularly to FIG. 9 which shows a step in a method for the continuous production of a series of bags from which the abovementioned bag 1 could originate.

As described in greater detail in patent EP 1 232 954, to start, a continuous sheath of plastic film, for example made of polyethylene, is advanced along a machine (not shown) and this sheath is cut longitudinally down its center to obtain two separate half-sheaths.

Next, on each half-sheath, circular or elliptical portions are cut out at regular intervals corresponding to once the width of a bag (or twice the width of a bag if there is to be a single lateral notch per bag), so as to form semi-circular or semi-elliptical notches 12 after the longitudinal edge of the sheet 20 of the half-sheath is folded inward, as shown in FIG. 9.

Naturally, the notch may have any shape, for example square, rectangular or the like.

Next, a plastic strip 6 is inserted into each fold 4, before it is sealed by a longitudinal heat weld to form the hem. Then, an elastic strip 16 is inserted in the sheath, along the free edge of the fold 4, overlapping it at least partially.

Naturally, the operations could be entirely reversed, placing the elastic strip 16 first and then heat welding the fold 4 to form the hem.

The method is the same in both cases: the inner edge of the fold is heat welded (along a line 4*a*) to each face of the sheet 20 to form the hems, in the direction of advance F.

Then, at regular intervals corresponding to the width of a bag, pairs of heat welds 2*a* and 3*a* are made substantially halfway between the semi-circular or semi-elliptical cut-outs. Each pair of heat welds 2*a* or 3*a* is such that it is possible to then separate the individual bags by cutting transversely or pre-cutting between the heat welds of each pair.

The machine also makes transverse heat welds 17 limited to the portion corresponding to the elastic strip 16 so as to form the abovementioned intermediate connection regions limiting the effective relaxed length of the elastic band.

Naturally, the order of the steps for making the heat welds 4*a*, 2*a* and 3*a*, and 17 can be modified while remaining within the scope of the invention.

Figure 10:
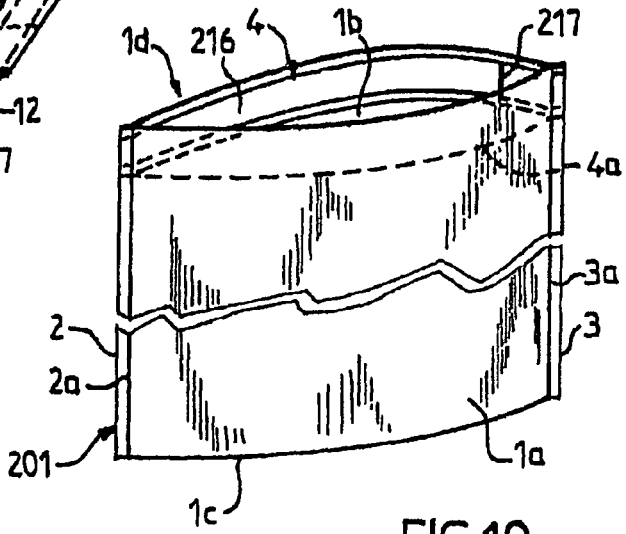
FIG. 10 is a view similar to FIG. 1, but showing a fifth embodiment of the bag according to the invention, without a plastic drawstring.

A fifth embodiment will now be described with reference to FIG. 10 which shows a bag 201 which differs from the preceding bags essentially in that it does not comprise any non-elastic drawstring, the bag 201 simply comprising an elastic band 216 along one face 1*b* of the bag, on the inside, as shown, or on the outside. Preferably, this bag 201 also has an internal fold 4 whose lower inner edge 4*a* is not necessarily welded to the rest of the bag, outside of the lateral edges 2 and 3. Thus, the elastic band 216 is placed in line with this internal fold 4 in such a way that the limited transverse weld 217, located between the lateral welds 2*a* and 3*a*, is reinforced by the double thickness of material at the fold 4.

Naturally, the other variant embodiments of the elastic band illustrated with reference to FIGS. 1 to 9 are applicable to the bag 201 which has no plastic drawstring. In particular, the elastic band 216 could be cut into two tapes as in FIG. 7, or placed on the outside as in FIG. 6, or comprise two intermediate connection regions as in FIGS. 3 to 5. Likewise, the overlap between the fold and the elastic band may be total or partial, as shown in the other figures.

Although the invention has been described in relation to several particular embodiments, it is of course in no way limited to them and comprises all technical equivalents of the means described and their combinations if they fall within the scope of the invention.

The invention claimed is:

1. A bag (1, 101, 201), comprising:

two opposite faces (1*a*, 1*b*) joined together around an entire periphery except for one longitudinal edge, the two joined faces forming an interior with an opening (1*d*) at said longitudinal edge, the two joined faces forming a rim at the opening sized to be positioned over a peripheral edge of a container, the two faces of the bag being welded to one another along two opposite lateral edges (2, 3), and a first face of the two faces having, near said opening, an elastic band extending from a first of the two lateral edges to a second of the two lateral edges, the elastic band being joined to said first face at each of the two lateral edges, and also joined to the first face at an intermediate joining position between the two lateral edges such that a first length (L1) of the elastic band between each of the two lateral edges is greater than a second length (L2) of the elastic band between the intermediate joining position and an other joining position, said second length (L2) corresponding to an effective relaxed length of said elastic band, and the elastic band being free of adhesion to said first face along an entirety of the second length (L2), and the second length (L2) of the elastic band having an elasticity sufficient to, when the rim is positioned over the peripheral edge of the container, i) stretch over the opening to a position on a second of the two faces and ii) exert an elastic force sufficient to hold the rim onto the peripheral edge of the container.

2. The bag as claimed in claim 1, wherein each face of the bag comprises a hem (8) bordering said opening (1*d*), and wherein a non-elastic drawstring (6, 106) located in the hem of each face, the non-elastic drawstring configured to be grasped from the outside via at least one notch (12, 112) made through the hem.

3. The bag as claimed in claim 2, wherein each face of the bag is folded inward to form a fold (4) along the longitudinal edge of the bag such that a first part of the fold (4) forms the hem (8) and a second part of the fold extends beyond the first part to form a skirt (4*b*), said elastic band being joined at each of the joining positions to at least partially overlap said skirt.

4. The bag as claimed in claim 1, wherein each face of the bag associated with said elastic band is folded inward to form a fold (4) along the longitudinal edge of the bag, and said elastic band at each of the joining positions at least partially overlaps said fold (4).

5. The bag as claimed in claim 1, wherein the elastic band is further welded to the bag at an additional intermediate joining position (17') located at a position spaced from the two lateral edges (2, 3) and from the intermediate joining position (17), the additional intermediate joining position forming the other joining position.

6. The bag as claimed in claim 1, wherein one of the two lateral edges furthest from the intermediate joining position forms the other joining position.

7. The bag as claimed in claim 1, wherein the elastic band is joined to an inside face of the bag.

8. The bag as claimed in claim 1, wherein the elastic band is joined to an outer face of the bag.

9. The bag as claimed in claim 1, wherein the elastic band is cut longitudinally into two vertically adjacent tapes (116*a*, 116*b*), and the joining positions lie in vertical extension of one another, so that the two vertically adjacent tapes form a closed loop with the bag, each of the tapes of said loop configured to extend around an opposite side of the container.

10. The bag as claimed in claim 1, wherein said elastic band has a degree of elongation of less than 150%.

11. The bag as claimed in claim 10, wherein said elastic band has a degree of elongation of approximately 100%.

12. The bag as claimed in claim 1, wherein the second length (L2) is sufficient for a person's hand to fit in its entirety between the intermediate joining position and the other joining position.

13. A series of bags (1, 101, 201), comprising:

a plurality of bags having longitudinal edges and lateral edges, the lateral edges of said bags being attached to one another, said plurality of bags having a longitudinal direction corresponding to longitudinal edges of said bags, wherein each bag comprises two opposite faces (1*a*, L*b*) joined together around a whole periphery of the bag except for one longitudinal edge, the two joined faces forming an interior of the bag with an opening (1*d*) at said longitudinal edge, the two joined faces forming a rim at the opening sized to be positioned over a peripheral edge of a container, the two faces of each bag being welded to one another along two opposite lateral edges (2, 3) of each bag, and a first face of the two faces having, near said opening, an elastic band extending from a first of the two lateral edges to a second of the two lateral edges, the elastic band being joined to said first face at each of the two lateral edges, and also joined to the first face at an intermediate joining position between the two lateral edges such that a first length (L1) of the elastic band between each of the two lateral edges is greater than a second length (L2) of the elastic band between the intermediate joining position and an other joining position, said second length (L2) corresponding to an effective relaxed length of said elastic band, and the elastic band being free of adhesion to said first face along an entirety of the second length (L2), and the second length (L2) of the elastic band having an elasticity sufficient to, when the rim is positioned over the peripheral edge of the container, i) stretch over the opening to a position on a second of the two faces and ii) exert an elastic force sufficient to hold the rim onto the peripheral edge of the container.

14. The series of bags as claimed in claim 13, wherein the elastic band is further welded to each bag at an additional joining position spaced from the two lateral edges and from the intermediate joining position, the additional intermediate joining position forming the other joining position.

15. The series of bags as claimed in claim 13, wherein one of the two lateral edges furthest from the intermediate joining position forms the other joining position.

16. The series of bags as claimed in claim 13, wherein the second length (L2) is sufficient for a person's hand to fit in its entirety between the intermediate joining position and the other joining position.

17. A bag, comprising:

first and second opposite faces joined together at a first longitudinal edge and two opposing lateral edges, the two opposing lateral edges spaced from each other by a first length (L1), the first and second faces forming an opening at a second longitudinal edge, and the first longitudinal edge forming a bottom of the bag, the first and second joined faces forming a rim at the opening sized to be positioned over a peripheral edge of a container; and an elastic band extending longitudinally along a direction of the first length (L1) at a position near the second longitudinal edge, the elastic band joined to the one of the first and second faces at first and second joining positions on the one of the first and second faces, at least one of the joining positions being spaced from both of the two opposing lateral edges, wherein an effective relaxed length of said elastic band corresponds to a second length (L2) between the first and second joining positions, the distance (L2) being shorter than the length (L1), wherein the elastic band is free of adhesion to said first face along an entirety of the second length (L2), and wherein the second length (L2) of the elastic band has an elasticity sufficient to, when the rim is positioned over the peripheral edge of the container, i) stretch over the opening to a position on a second of the two faces and ii) exert an elastic force sufficient to hold the rim onto the peripheral edge of the container.

18. The bag as claimed in claim 17, wherein one of the first and second joining positions is at one of the two lateral edges furthest from the intermediate connection region.

19. The bag as claimed in claim 17, wherein both of the first and second joining positions are spaced from the two lateral edges.

20. The bag as claimed in claim 17, wherein the second length (L2) is sufficient for a person's hand to fit in its entirety between the first and second joining positions.

* * * * *

UNITED STATES PATENT AND TRADEMARK OFFICE

CERTIFICATE OF CORRECTION

PATENT NO. : 8,556,508 B2
APPLICATION NO. : 10/572938
DATED : October 15, 2013
INVENTOR(S) : John Persenda It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2212 days.

Signed and Sealed this
Fifteenth Day of September, 2015

Michelle K. Lee

Michelle K. Lee
*Director of the United States Patent and Trademark Office*